US008608051B2

(12) United States Patent
Focke et al.

(10) Patent No.: US 8,608,051 B2
(45) Date of Patent: Dec. 17, 2013

(54) FOLDING BOX FOR CIGARETTES

(75) Inventors: Heinz Focke, Verden (DE); Doris Focke, legal representative, Verden (DE); Jürgen Focke, legal representative, Verden (DE); Gisbert Engel, Luttum (DE)

(73) Assignee: FOCKE & Co. (GmbH & Co. KG), Verden (DE)

( * ) Notice: Subject to any disclaimer, the term of this patent is extended or adjusted under 35 U.S.C. 154(b) by 1512 days.

(21) Appl. No.: 10/550,890

(22) PCT Filed: Mar. 17, 2004

(86) PCT No.: PCT/EP2004/002730

§ 371 (c)(1), (2), (4) Date: Sep. 27, 2005

(87) PCT Pub. No.: WO2004/085271

PCT Pub. Date: Oct. 7, 2004

(65) Prior Publication Data

US 2006/0191986 A1 Aug. 31, 2006

(30) Foreign Application Priority Data

Mar. 28, 2003 (DE) ..... 103 14 375

(51) Int. Cl.
*B65D 5/00* (2006.01)
*B65D 43/16* (2006.01)

(52) U.S. Cl.
USPC ..... 229/146; 229/160.1; 206/259

(58) Field of Classification Search
USPC ..... 229/160.1, 146, 125.08; 206/259, 263
See application file for complete search history.

(56) References Cited

U.S. PATENT DOCUMENTS

| | | | | |
|---|---|---|---|---|
| 3,907,194 | A | 9/1975 | Davenport et al. | |
| 4,134,531 | A | 1/1979 | Martinez et al. | |
| 4,753,383 | A | 6/1988 | Focke et al. | |
| 5,044,550 | A * | 9/1991 | Lamm | 229/160.1 |
| 5,323,957 | A | 6/1994 | Roosa | |
| D356,183 | S | 3/1995 | Conti | |
| 5,487,468 | A * | 1/1996 | Sheahan | 206/242 |

(Continued)

FOREIGN PATENT DOCUMENTS

| | | |
|---|---|---|
| DE | 31 16 924 A1 | 2/1983 |
| DE | 36 24 345 A1 | 1/1988 |

(Continued)

OTHER PUBLICATIONS

Canadian Office Action, dated May 30, 2011, for corresponding Application No. 2,520,318.

(Continued)

*Primary Examiner* — Nathan J Newhouse
*Assistant Examiner* — Christopher Demeree
(74) *Attorney, Agent, or Firm* — Sughrue Mion, PLLC

(57) ABSTRACT

The hinge-lid pack comprising box part (11) and lid (12) features a polygon-like configuration in the region of its side walls (22, 23), namely having angular wall legs (28, 29) and a narrow, transverse side wall (22, 23). The cross-sectional shape of the hinge-lid pack thus conforms to the contour of a cigarette group as the pack's contents, with the cigarette group having at its edges adjacent to the side walls (22, 23) a marginal transverse row of 2 cigarettes and adjacent thereto a transverse row of 3 cigarettes.

6 Claims, 5 Drawing Sheets

(56) References Cited

U.S. PATENT DOCUMENTS

Figure 2:
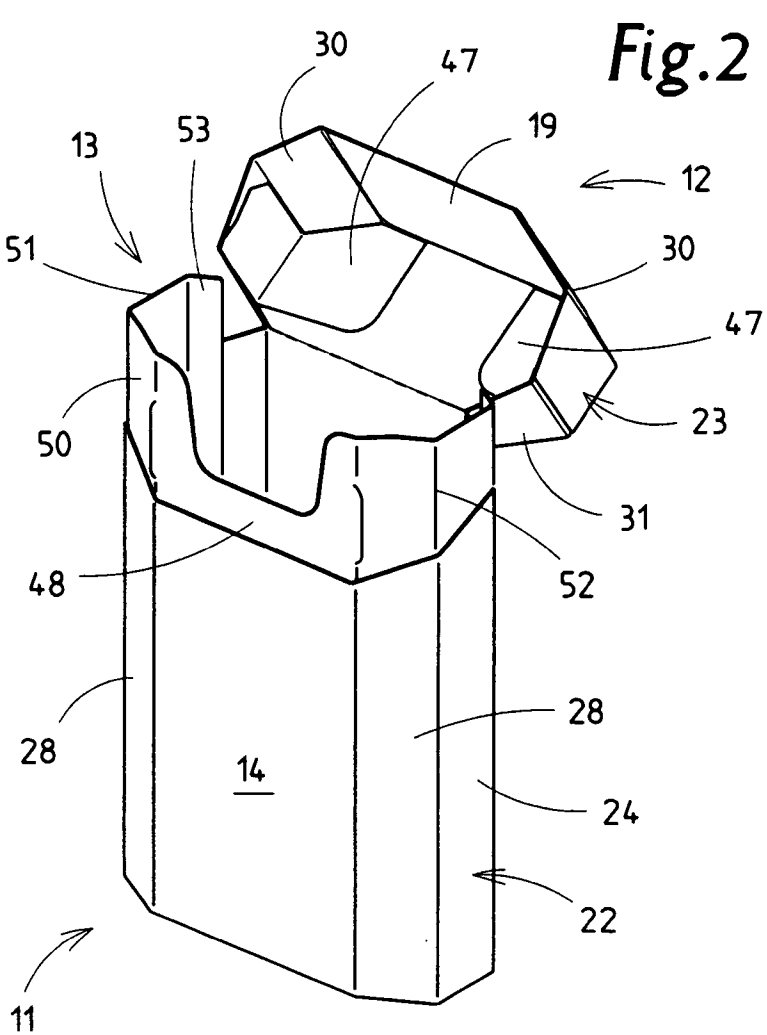

| | | | | |
|---|---|---|---|---|
| D438,106 | S | 2/2001 | Brown et al. | |
| 6,343,691 | B1 * | 2/2002 | Focke et al. | 206/268 |
| 6,832,677 | B2 * | 12/2004 | Bohdan | 193/2 R |
| 2002/0179464 | A1 * | 12/2002 | Focke et al. | 206/259 |

FOREIGN PATENT DOCUMENTS

| | | | | | |
|---|---|---|---|---|---|
| DE | 201 01 554 | U1 | | 4/2001 | |
| DE | 100 47 447 | A1 | | 5/2001 | |
| DE | 101 35 409 | A1 | | 2/2003 | |
| DE | 101 56 847 | A1 | | 5/2003 | |
| EP | 414 532 | A1 | | 2/1991 | |
| EP | 587 132 | A1 | | 3/1994 | |
| GB | 2152905 | A | * | 8/1985 | B65D 5/18 |
| JP | 62-016334 | A | | 1/1987 | |
| JP | 63-033283 | A | | 2/1988 | |
| JP | 04-279446 | A | | 10/1992 | |
| JP | 4279446 | A | | 10/1992 | |
| JP | 05-054247 | A | | 7/1993 | |
| JP | H05-054247 | U | | 7/1993 | |
| JP | 6039702 | U | | 5/1994 | |
| JP | H06-072821 | U | | 10/1994 | |
| JP | 10-035655 | A | | 2/1998 | |
| JP | 2005-523854 | A | | 8/2005 | |
| WO | WO 01/15999 | A1 | | 3/2001 | |
| WO | WO 02 32786 | A1 | | 4/2002 | |
| WO | 03/011715 | A1 | | 2/2003 | |
| WO | 03/018408 | A3 | | 3/2003 | |
| WO | WO 03/018408 | A2 | | 3/2003 | |

OTHER PUBLICATIONS

Vietnamese Office Action for corresponding Application 1-2005-01582 dated May 11, 2011.

* cited by examiner

Fig. 7
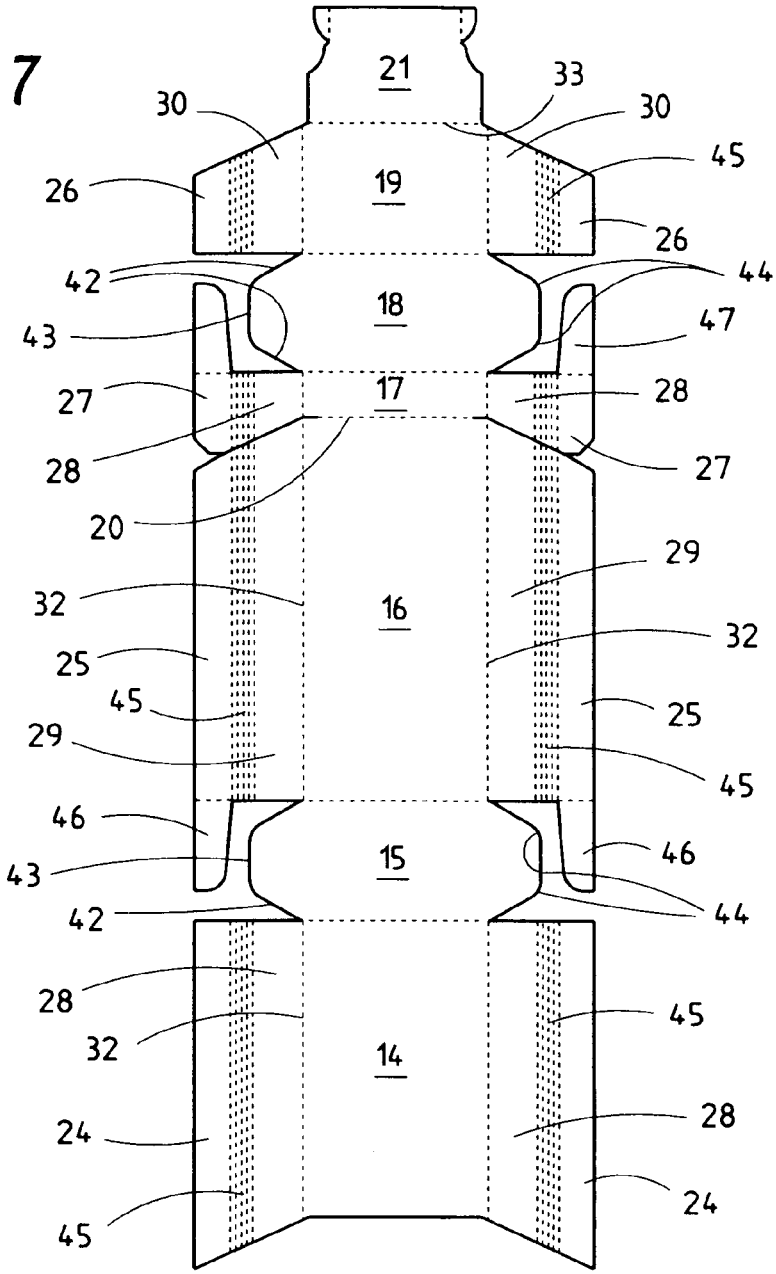
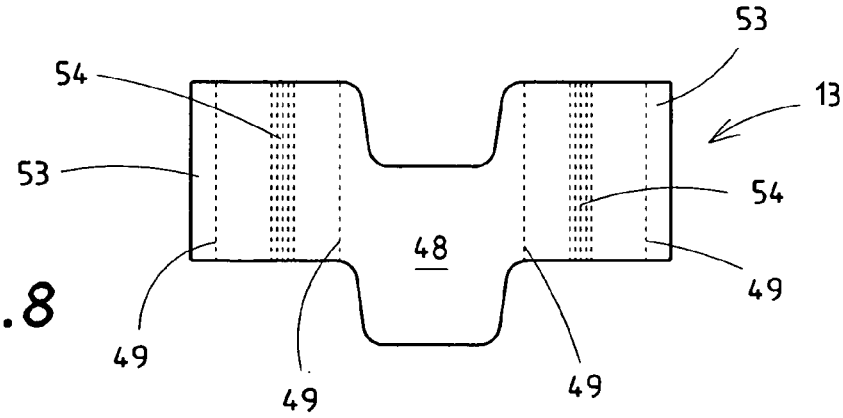
Fig. 8

Fig.9
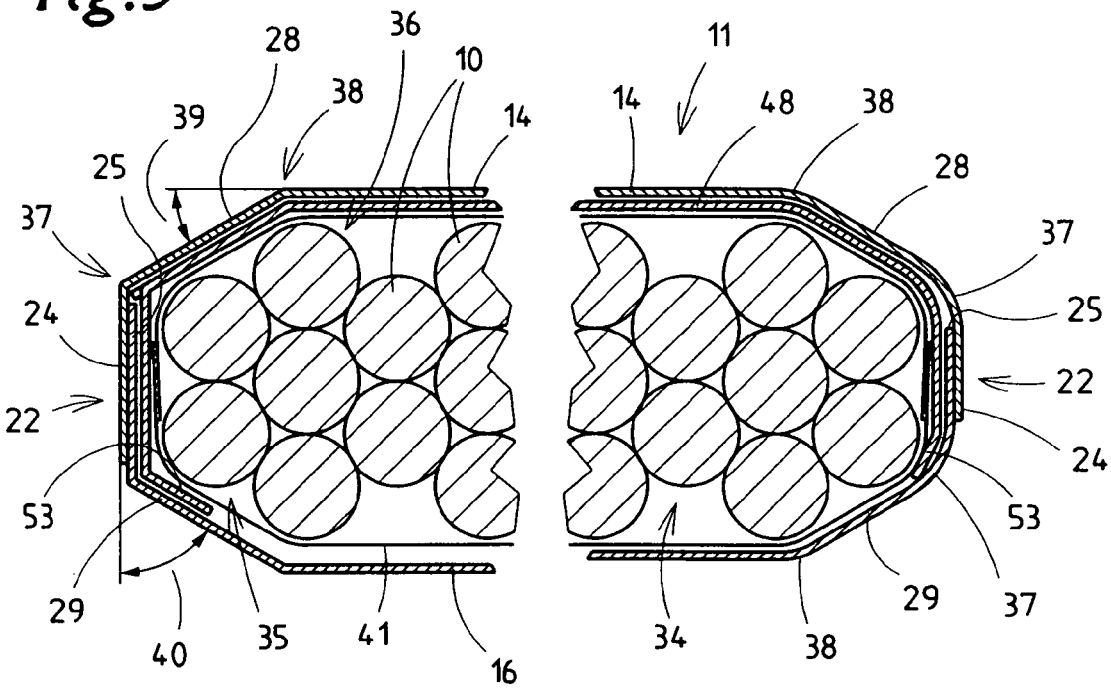
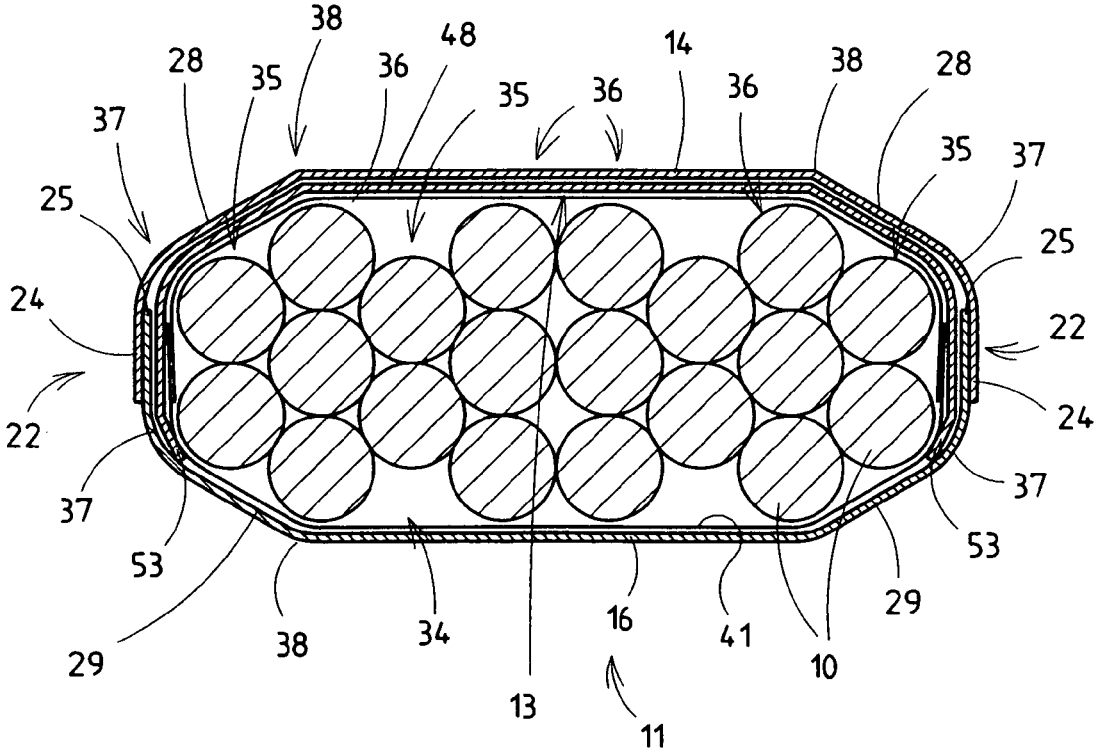
Fig.10

FOLDING BOX FOR CIGARETTES

The invention relates to a hinge-lid pack for cigarettes comprising a box part with box front wall, box rear wall, box side walls and base wall, and a lid, which is pivotably attached to the box part and which comprises lid front wall, lid rear wall, lid side walls and end wall.

Hinge-lid packs for cigarettes have been employed for decades throughout the world. Also known are embodiments with beveled or rounded pack edges.

The object of the present invention is to design a cigarette pack of the hinge-lid type that achieves an optimum conformation of its shape to the outer form or contour of the pack's contents, which consists of a cigarette group, even when the cigarettes assume a special formation.

In order to achieve this object, the hinge-lid pack according to the invention is characterized in that a region facing at least one of the side walls has a cross-section that is configured as being (approximately) trapezoid in shape, with converging material strips or legs connecting the respective side walls with the box front wall and lid front wall, on one hand, and the box rear wall and lid rear wall, on the other hand, said material strips having a width that is greater than the diameter of one cigarette and less than the aggregate dimension of two adjacently positioned cigarettes.

One special feature is the adaptation of the cross-sectional contour of the hinge-lid pack to the contour of the cigarette group. Cigarettes at the edge of the pack are positioned such that converging wall legs of the hinge-lid box lie in each case against two cigarettes of two transverse marginal rows, with two cigarettes positioned in each of the (obtuse) angulation positions. Furthermore, each of the converging wall legs abuts two cigarettes of the cigarette group, as do each of the side walls, correspondingly reduced in width, abutting the two cigarettes of the marginal transverse rows.

The lateral regions of the hinge-lid pack which face the side walls are preferably configured such that, for a cigarette group comprising marginal sub-groups of five cigarettes arranged with an outer transverse row of two cigarettes and an adjacent transverse row of three cigarettes, the cigarette group is appropriately enclosed so that each of the converging wall legs lies against two cigarettes of two marginal transverse rows and that each side wall, correspondingly reduced in width, lies against two cigarettes of the marginal transverse row.

The hinge-lid packs, which are configured as having a polygon-like contour preferably in the region of both side walls, can have edges formed by bending between the wall legs, on one hand, and the side walls, front wall and rear wall, on the other hand. However, the preferred embodiment is one in which exhibits rounded edges between the wall legs, on one hand, and the side wall, on the other hand. Furthermore, the edges between the wall legs, on one hand, and the front and rear wall, respectively, on the other hand, are rounded, with all rounded regions conforming in their dimensions to the contour or the dimensions of the cigarettes.

A further special feature is the arrangement and design of a collar arranged in the box part and in principle a constituent element of this type of pack.

Finally, the invention relates to the design of blanks for the production of hinge-lid packs.

Figure 1:
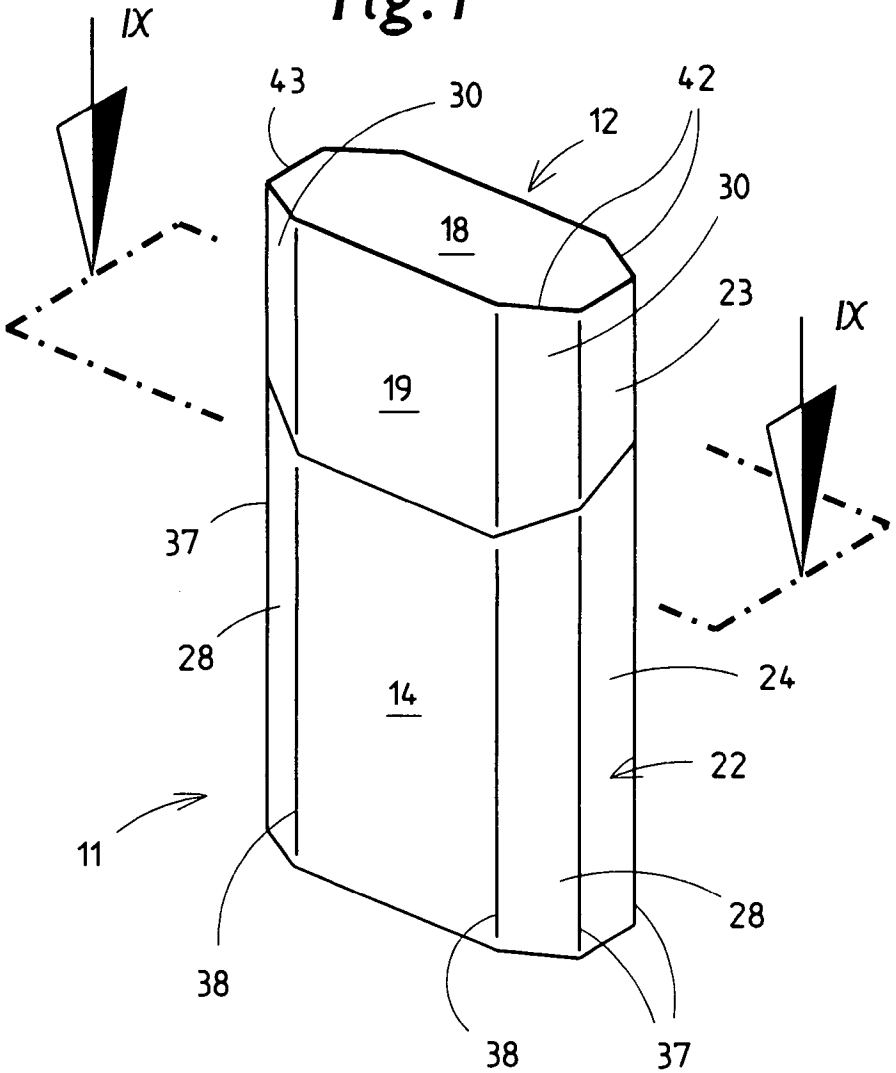
Figure 3:
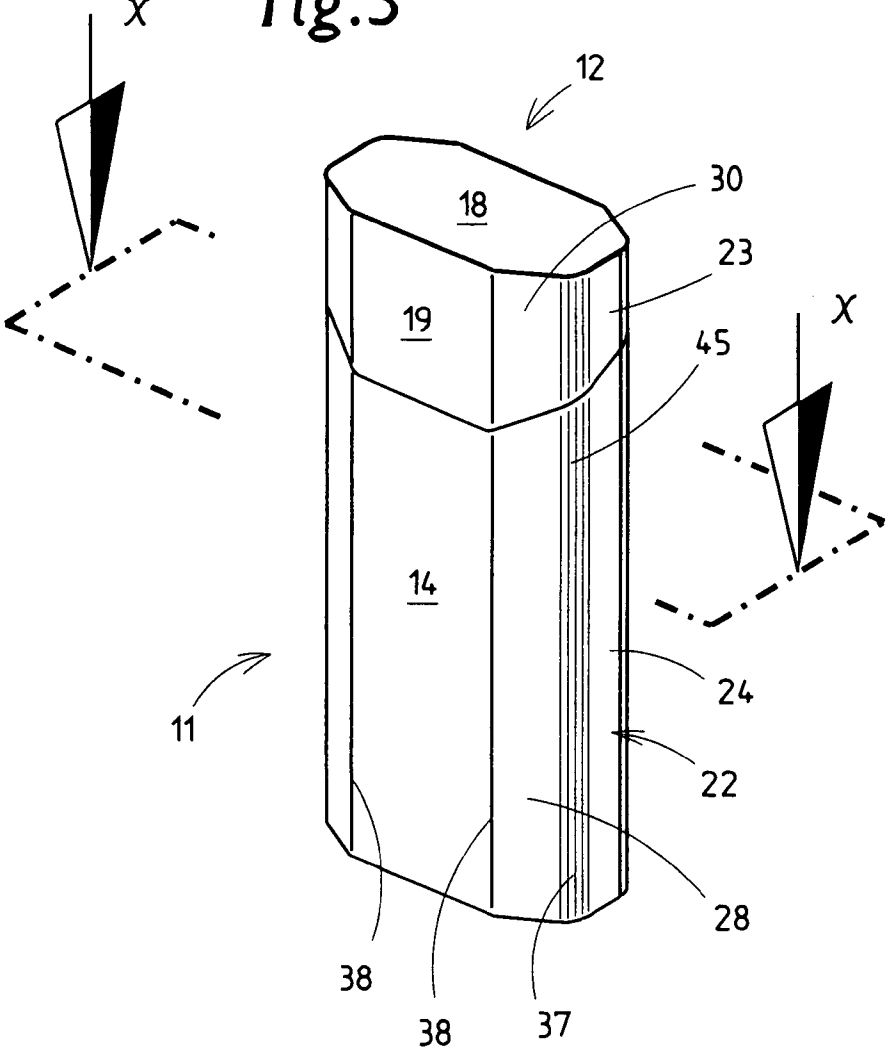

Further special features of the invention will be discussed below on the basis of drawings, which show:

FIG. 1 a perspective view of a hinge-lid pack in its closed position,

FIG. 2 the pack according to FIG. 1 with open lid,

FIG. 3 a perspective view of a hinge-lid pack in an embodiment modified with respect to that shown in FIG. 1.

Figure 4:
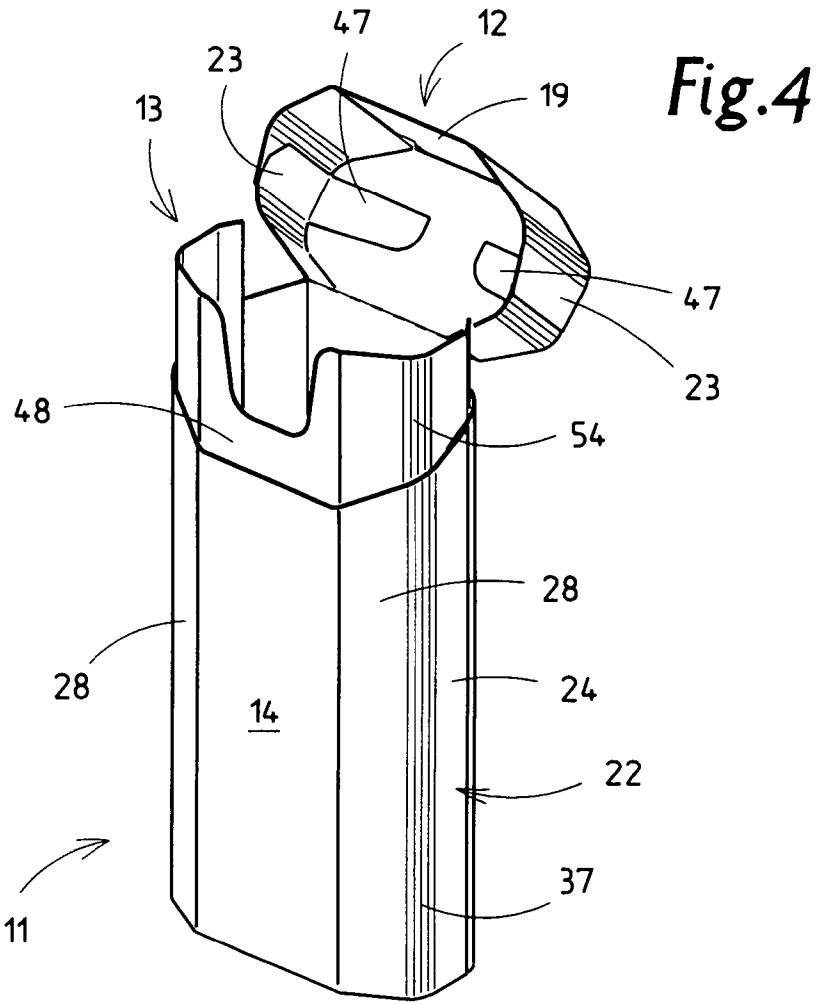
Figure 5:
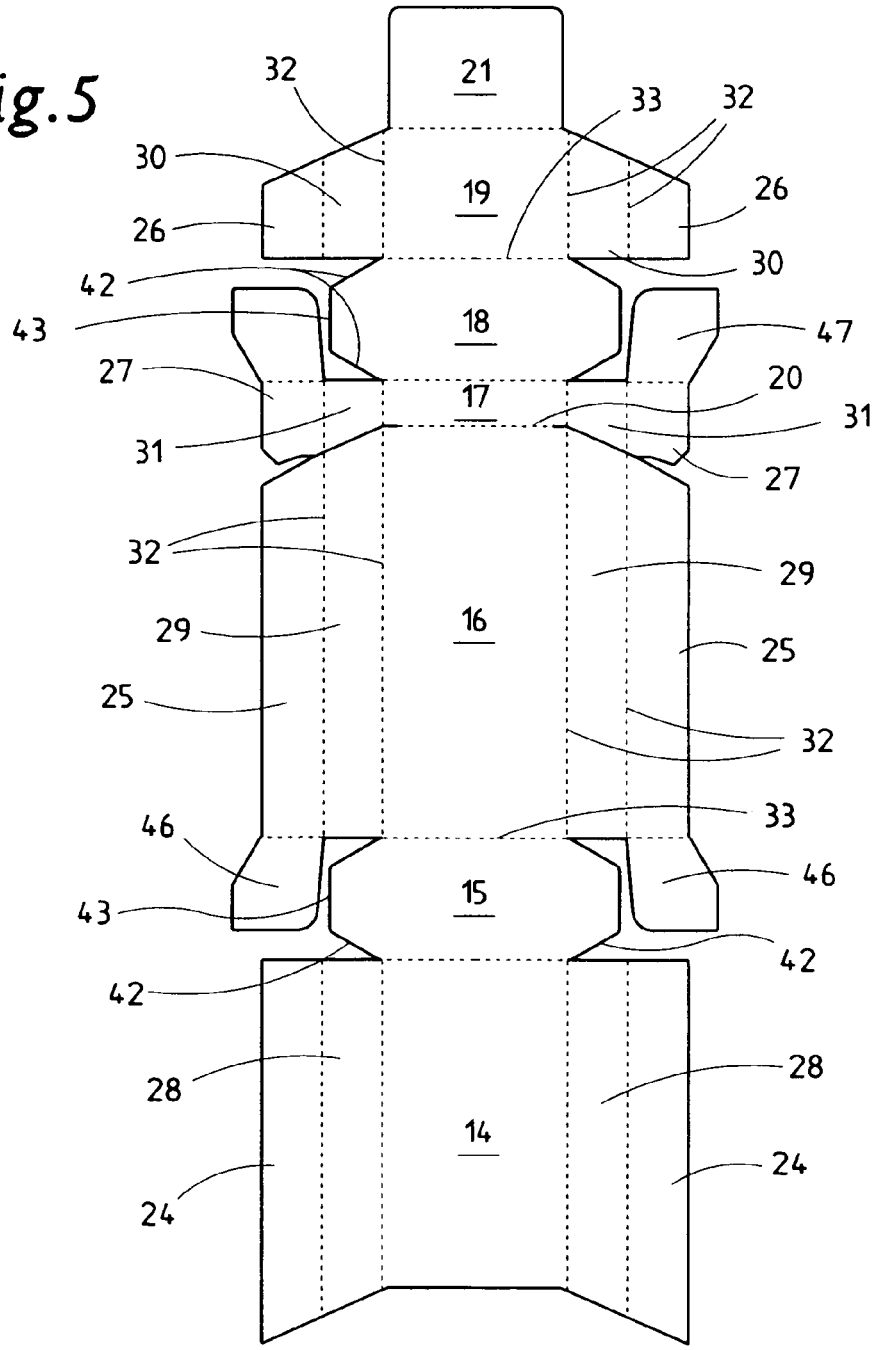
Figure 6:
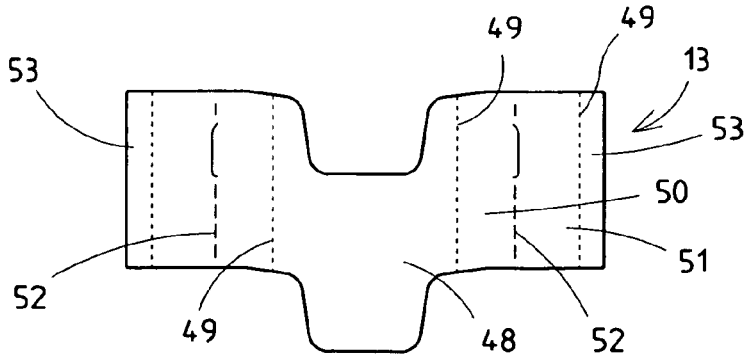

FIG. 4 the hinge-lid pack according to FIG. 3 with open lid,

FIG. 5 a spread blank for a hinge-lid pack according to FIG. 1, FIG. 2, FIG. 6 a blank for a collar, FIG. 7 a spread blank for packs according to FIG. 3, FIG. 4, FIG. 8 a blank for a collar, FIG. 9 a horizontal sectional view of a hinge-lid pack filled with cigarettes along plane IX-IX of FIG. 1 (left diagram) and a further exemplary embodiment (right diagram)

FIG. 10 a horizontal sectional view of a hinge-lid pack along the sectional plane X-X of FIG. 3.

The shown packs are hinge-lid packs for cigarettes 10. In its basic design, a hinge-lid pack comprises a (lower) box part 11 and a lid 12. A collar 13, here made from a separate blank, is attached to the front side in the box part 11. Part of the collar 13 projects from the box part 11 and is enclosed by the lid 12 when the latter is closed.

Box part 11 and lid 12 are made from a one-piece blank. This blank is constructed to form successive regions in the longitudinal direction for a box front wall 14, a base wall 15, a box rear wall 16, a lid rear wall 17, an end wall 18 and a lid front wall 19. Box part 11 and lid 12 are connected to each other in the region of box rear wall 16 and lid rear wall 17 by means of a transverse hinge line 20 that extends only in the region of the rear wall 16, 17. A lid inner tab 21, connected to a free side of the lid front wall, is folded against the inner side of the lid front wall 19 and connected thereto in the finished pack.

Attached to the box front wall 14, box rear wall 16, lid rear wall 17 and lid front wall 19 are folding tabs for the formation of box side walls 22 and lid side walls 23. These side walls 22, 23 are formed by overlapping and mutually connected folding tabs, namely box side tabs 24, 25, on one hand, and lid side tabs 26, 27, on the other hand. The side tabs 24, 26 form in each case the outer side of the double-layer side walls 22, 23. The side tabs 25, 27 lie on the inside.

One special feature of the hinge-lid box is its design, or construction, in a region adjacent to the box side walls 22 and lid side walls 23. Configured with comparatively smaller width, the box front wall 14, box rear wall 16, lid rear wall 17 and lid front wall 19 are respectively connected by means of an intermediate piece to the side walls 22, 23 or to the corresponding side tabs 24 . . . 27. These intermediate pieces are a box leg 28, 29 and the respective lid legs 30, 31. These wall legs 28 . . . 31 are formed by material strips between the side tabs 24 . . . 27, on the one hand, and the associated walls, namely box front wall 14, box rear wall 16, lid rear wall 17 and lid front wall 19, on the other hand. All wall regions of the blank are delimited from one another by longitudinal folding lines 32 and transverse folding lines 33.

The described regions of the blank—as seen in the cross-section of the pack—are arranged at an angle to one another. The material strips, namely box legs 28, 29 and lid legs 30, 31 are directed at an acute angle 39 of in particular approximately 30° to the adjacent box front wall 14 or box rear wall 16, and to the lid rear wall 17 or lid front wall 19, respectively. The side walls, namely box side walls 22 and lid side walls 23 are preferably directed at an angle 40 of approximately 60° to the material strips or legs 28 . . . 31. This results in an approximately trapezoidal-shaped pack cross-section in its side region. (FIG. 9, FIG. 10).

The dimensions of the hinge-lid boxes and in particular of the approximately trapezoidal side region arise from the dimensions of the cigarettes 10, but in particular from the selected formation of a cigarette group 34 as the contents of the hinge-lid pack. For a preferred capacity of twenty cigarettes 10, a formation of transverse rows 35, 36 of cigarettes 10 provided, with each marginal transverse row 35 consisting of two adjacent cigarettes 10 and an adjacent transverse row 36 consisting of three cigarettes 10. The cigarettes 10 of the adjacent rows 35, 36 are thus arranged in a "saddle position", i.e. offset to one another. The contents of the hinge-lid box thus exhibit a convergent cross-sectional profile at their edges. This cross-sectional profile is accommodated by the profile of the hinge-lid pack in an almost completely positive fit.

One special feature involves the dimensions of the material strips or legs 28 . . . 31. These have the same width, which is considerably larger than the diameter of a single cigarette 10, yet smaller than the sum diameter of two cigarettes 10 lying adjacent to one another. The chosen dimensions make it possible for cigarettes 10 in each of the transverse rows 35, 36 to be arranged in the region of an angulation 37, 38 formed by folding lines. This results in a dimensionally stable hinge-lid pack, since each of the wall areas, which are set at an angle to each other, namely legs 28 . . . 31 and side wall 22, 23, are supported by two adjacent cigarettes 10. As an alternative, the cigarette group 34 can also be formed such that a transverse row 35 of two cigarettes is arranged only at the respective edge of the group, which is otherwise formed by transverse rows 36 of three cigarettes 10 each.

The design of the hinge-lid pack in its lateral region results in a savings of material. Accordingly, only the side walls 22, 23 have a two-layer configuration, i.e. with the side tabs 24 . . . 27 having a width which corresponds approximately to the width of the side walls 22, 23.

A further special feature is that individual or all upright pack edges, i.e. the angulations 37, 38, are rounded. The exemplary embodiment pursuant to FIG. 3, FIG. 4, FIG. 7, FIG. 8 and FIG. 10 shows a particularly advantageous embodiment, in which merely the angulations 37 are configured as rounded edges with a preferably circular rounding to conform to the dimension or radius of the abutting cigarettes. In the most favorable case, the cigarettes 10 situated at the edges or corners assume a positive-fit when encased by the walls of the hinge-lid pack. Here the side tabs 24 . . . 27 are configured as being much smaller in width so that an overlap occurs only outside the roundings of the angulation 37. In the region of the angulation 38, the corners remain sharp but obtuse.

The design of the hinge-lid box with exclusively rounded edges or angulations 37, 38 is shown in a cross-section profile in the right detail illustration of FIG. 9. Both angulations 37, 38 are rounded, preferably of a circular shape which conforms to the dimensions of a cigarette 10.

The contents of the hinge-lid pack, namely the cigarette group 34, are surrounded by an inner liner 41 made of tin foil, paper or film.

The blanks for the production of the hinge-lid pack in its various embodiments are configured in a special manner. Pursuant to FIG. 5, the middle region defined by box front wall 14, box rear wall 16 etc. is configured with a smaller width than that of conventional hinge-lid packs. The overall width of the blank is also smaller than the width of a blank for a standard hinge-lid pack.

Base wall 15 and end wall 18 conform to the contour of the hinge-lid pack, specifically by means of trapezoid-shaped edge regions oblique edges 42 and a transverse edge 43. In the finished pack, the oblique edges 42 abut the box legs 28, 29 or the lid legs 30, 31. The transverse edge 43 abuts in each case the inner box side tab 25 (base wall 15) or the inner lid side tab 27 (end wall 18). In the embodiment pursuant to FIG. 7, a rounding 44 is formed in each case between the oblique edges 42, on one hand, and the transverse edges 43, on the other, corresponding to the curves of the angulations 37.

The curves or rounded angulations 37, 38 in the exemplary embodiment pursuant to FIG. 3, FIG. 4, FIG. 10 or in the right-hand exemplary embodiment pursuant to FIG. 9 are defined by a curvature strip 45 of the blank. This curvature strip 45 usually comprises a number of parallel scorings which are impressed upon the packaging material (thin cardboard) by stamping. In the embodiment in the right-hand illustration of FIG. 9, the inner longitudinal folding line 32 is also configured as a curvature strip 45.

Base wall 15, on one hand, and end wall 18, on the other hand, are connected to the box side wall 22 and the lid side wall 23, respectively, specifically by means of base corner tabs 46 and lid corner tabs 47, respectively. The corner tabs 46, 47 extend as a continuation of the inner box side tabs 25 and the lid side tabs 27, respectively. In the exemplary embodiment pursuant to FIG. 1, FIG. 2 and FIG. 5, the corner tabs 46, 47 are configured to provide a matching, positive-fit support of the outer tab edges in the region of the base wall 15 to the box front wall 14 and box legs 28. Correspondingly, the exposed tab edges of the lid corner tabs 47 abut the lid front wall 19 and the adjacent lid leg 30 (FIG. 2). This increases the dimensional stability of the pack.

In the exemplary embodiment with rounded edges (FIG. 3, FIG. 4 and FIG. 7), the width of the corner tabs 46, 47 correspond to the width of their associated folding tabs 25, 27. The overall width of the blank is not exceeded in the region of the corner tabs 46, 47. In the finished hinge-lid pack, the corner tabs 46, 47 are connected to the base wall 15 and end wall 18 by adhesive bonding.

The collar 13, which here is made from a separate blank, conforms to the shape of the hinge-lid pack. In the embodiment pursuant to FIG. 5—and applicable to FIG. 1, FIG. 2—a collar front wall 48 is delimited by collar folding lines 49. Joined at either side are laterally delimited material strips 50, 51, which are delimited from each other by a more pronounced collar folding line 52. In this exemplary embodiment the latter comprises a perforation line, which ensures a reliable folding of the material strips 50, 51 in their angled position to each other. A special feature is a collar leg 53, bordering the outer material strip 51, which is delimited by a collar folding line 49 and which in the finished pack abuts the rear box leg 29 and lid leg 31 (FIG. 4). This collar leg 53 ensures a high degree of stability. Furthermore, by being folding inwards in the pack's contour, this collar leg 53 facilitates the closing of the lid 12 once it has been opened.

In the embodiment pursuant to FIG. 8—applicable to FIG. 3, FIG. 4—the middle collar folding line 52 of FIG. 6 has been replaced by a curvature strip 54, which ensures the conformity of the collar to the pack's shape pursuant to FIG. 3, FIG. 4 in the region of the rounded angulation 37.(FIG. 10).

The invention claimed is:

1. Hinge-lid pack for cigarettes (10) comprising a box part (11) with box front wall (14), a box rear wall (16), box side walls (22) and a base wall (15), a lid (12) which is pivotably attached to the box part (11) and which comprises a lid front wall (19), a lid rear wall (17), lid side walls (23) and an end wall (18), and a collar (13), made from a separate blank, being positioned within an upper part of the box part (11), characterized by the following features:

a) the hinge-lid pack with box part (11) and lid (12) is configured as having an octagonal cross-section across its entire dimensions, b) a lateral region facing the box side walls (22) and lid side walls (23) is configured as having a cross-section that is trapezoid in shape, with converging material strips, namely legs (28, 29; 30, 31), connected respectively to the box front wall (14), box rear wall (16) and to the lid front wall (19) and lid rear wall (17), c) the width of the legs (28, 29; 30, 31) is greater than the diameter of one cigarette (10) yet less than the aggregate diameter of two adjacent cigarettes (10), d) the legs (28, 29; 30, 31) are directed at an angle (39) of approximately 30° to the box front wall (14) and box rear wall (16), and to the lid front wall (19) and lid rear wall (17), respectively, and are directed at an angle (40) of approximately 60° to the transverse box side wall (22) and lid side wall (23), e) a cigarette group (34), as the pack's contents, comprises transverse rows of said cigarettes, namely transverse rows (35) with two adjacent cigarettes (10) and transverse rows (36) with three adjacent cigarettes (10), f) the cigarettes (10) of the adjacent transverse rows (35 and 36) are arranged in a saddle position, i.e. are offset to one another, g) cigarettes (10) of a marginal transverse row (35) of two adjacent cigarettes (10) are arranged in the region of angulations (37) between a box side wall (22) and lid side wall (23), on one hand, and box legs (28) and lid legs (30), on the other hand, h) marginal cigarettes of an adjacent transverse row (36) with three cigarettes (10) are arranged in the region of an angulation (38) between the box legs (28) and lid legs (30), on one hand, and box front wall (14), box rear wall (16), lid front wall (19) and lid rear wall (17), on the other hand.

2. The hinge-lid pack according to claim 1, characterized in that the width of the side walls (22, 23) comprised of two overlapping side tabs (24, 25; 26, 27) is somewhat less than the dimensions of two adjacent cigarettes (10), in particular of the marginal first transverse row (35).

3. The hinge-lid pack according to claim 1, characterized by the following features:

a) the angulations (37) and/or the angulations (38) are each formed as rounded corners, namely with a circular-shaped rounding formed by curvature strips (45), specifically by conforming to the contour and dimension of the cigarettes (10) lying opposite the angulations (37, 38), and b) the angulations (37) bordering the side walls (22, 23) are rounded or configured as rounded corners and that the angulations (38) between the legs (28, 29; 30, 31), one hand, and the front side and rear side, on the other hand, have an angular configuration.

4. The hinge-lid pack according to claim 1, characterized in that, in the case of rounded angulations (38), the side tabs (24, 25; 26, 27) extend exclusively in the region between the adjacent, rounded angulations (38) and overlap one another.

5. Hinge-lid pack according to claim 1, characterized in that base corner tabs (46) and lid corner tabs (47) are arranged as the continuation of interior box side tabs (25) and lid side tabs (27), respectively, with the corner tabs (46, 47) being adapted to the contour of the base wall (15) and end wall (18) by means of corresponding exposed tab edges, or corresponding in their transverse dimensions to the width of their assigned side tabs (25, 27).

6. Hinge-lid pack according to claim 1, wherein:

the collar (13) made from a separate blank conforms to the contour or cross-sectional profile in the region of the legs (28, 29; 30, 31) to form material strips (50, 51) that are arranged at an angle to one another, and attached to a marginal material strip (51) of the collar (13) is a collar leg (53) which abuts the inner side of the rear box legs (29) and lid legs (31).

* * * * *